US010865952B1

(12) United States Patent
Rao et al.

(10) Patent No.: US 10,865,952 B1
(45) Date of Patent: Dec. 15, 2020

(54) SYSTEM CONFIGURED FOR MOUNTING ITEMS TO A CEILING SUPPORT GRID AND METHOD OF MOUNTING

(71) Applicant: Litetronics International, Inc., Bedford Park, IL (US)

(72) Inventors: Raghu Rao, Romeoville, IL (US); Robert Sorensen, Bedford Park, IL (US)

( * ) Notice: Subject to any disclaimer, the term of this patent is extended or adjusted under 35 U.S.C. 154(b) by 0 days.

(21) Appl. No.: 16/600,458

(22) Filed: Oct. 12, 2019

(51) Int. Cl.
*F21S 8/04* (2006.01)
*F21S 8/06* (2006.01)
*F21S 8/00* (2006.01)

(52) U.S. Cl.
CPC ..... *F21S 8/043* (2013.01); *F21S 8/031* (2013.01); *F21S 8/06* (2013.01)

(58) Field of Classification Search
CPC ..... F21V 19/004; F21V 21/08; F21V 21/088; F21V 21/096; F21S 8/043; F21S 8/031; F21S 8/06
USPC ..... 248/228.7, 229.16, 229.26
See application file for complete search history.

(56) References Cited

U.S. PATENT DOCUMENTS

2010/0296285 A1* 11/2010 Chemel ..... F21S 2/005 362/235
2012/0293309 A1* 11/2012 Spiro ..... F21V 27/00 340/12.32
2019/0145611 A1* 5/2019 May ..... F21V 21/088 362/147

* cited by examiner

*Primary Examiner* — Julie A Bannan
(74) *Attorney, Agent, or Firm* — Witters & Associates; Steve Witters

(57) ABSTRACT

Technologies are described for a system and ceiling grid mounting clip configured for mounting items solely to a lower longitudinally extending flange of a ceiling support grid and method of mounting.

18 Claims, 5 Drawing Sheets

SYSTEM CONFIGURED FOR MOUNTING ITEMS TO A CEILING SUPPORT GRID AND METHOD OF MOUNTING

FIELD OF THE DISCLOSURE

This invention generally relates to systems for mounting to a ceiling support grid and a method of mounting to a ceiling support grid.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ceiling support grids and ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched. Typically, ceiling panels may be installed from beneath the ceiling support grid.

Often times luminaires are installed in ceiling support grids, for example, a troffer or other luminaire that has a perimeter substantially the same as a perimeter of a ceiling panel is often installed and held in the ceiling support grid. These luminaires are typically placed in an opening in the ceiling support grid, the opening formed with removal of a panel, to have light directed downward through the opening in the ceiling support grid.

It may be desired to mount a light source, lamp, or other item to a ceiling support grid and have the ceiling panels held in the grid openings.

SUMMARY

In at least one embodiment of the present disclosure, a lighting system configured for mounting a lamp to a ceiling support grid is disclosed. The ceiling support grid comprises a lower longitudinally extending flange and an upper longitudinally extending flange, wherein the upper longitudinally extending flange perpendicularly extends up from a longitudinally extending center axis of the lower longitudinally extending flange. The system comprises a lamp comprises a longitudinally extending housing having a length substantially greater than a width. The housing is configured to be mounted solely to the lower longitudinally extending flange of the ceiling support grid, have its longitudinal axis parallel with the longitudinal axis of lower longitudinally extending flange to which it is mounted, and solely extend down from the lower longitudinally extending flange to which it is mounted. The system also comprises at least one ceiling grid mounting clip or at least one ceiling grid mounting magnet configured for the mounting of the lamp housing solely to the lower longitudinally extending flange of the ceiling support grid.

In at least one other embodiment of the present disclosure, a method of mounting a longitudinally extending lamp to a ceiling support grid comprises aligning a longitudinally extending axis of the lamp with a longitudinally extending axis of the ceiling support grid; cooperating at least one ceiling grid mounting clip or at least one magnet with the longitudinally extending lamp and a lower longitudinally extending flange of the ceiling support grid and mounting the aligned lamp solely to the ceiling support grid, wherein the lamp solely extends down from the lower longitudinally extending flange to which it is mounted; and electrically communicating the lamp with a power supply.

In at least one additional embodiment of the present disclosure, a ceiling grid mounting clip configured for mounting an item to a ceiling support grid is provided. The ceiling support grid has a lower longitudinally extending flange with a first edge and a second edge. The ceiling grid mounting clip comprises a first leg having a lower portion configured and disposed to cooperate with a first side of the item to be mounted and an upper portion configured and disposed to cooperate with the second edge of the lower longitudinally extending flange and a second leg having a lower portion configured and disposed to cooperate with a second side of the item to be mounted and an upper portion configured and disposed to cooperate with the first edge of the lower longitudinally extending flange. The first leg of the ceiling grid mounting clip is configured and disposed to slidingly engage the second leg of the ceiling grid mounting clip and the cooperation of the item with the lower portions of the legs of the ceiling grid mounting clip and the cooperation of the lower flange with the upper portions of the legs of the ceiling grid mounting clip holds and mounts the item being mounted to the ceiling support grid.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

DETAILED DESCRIPTION

Figure 1:
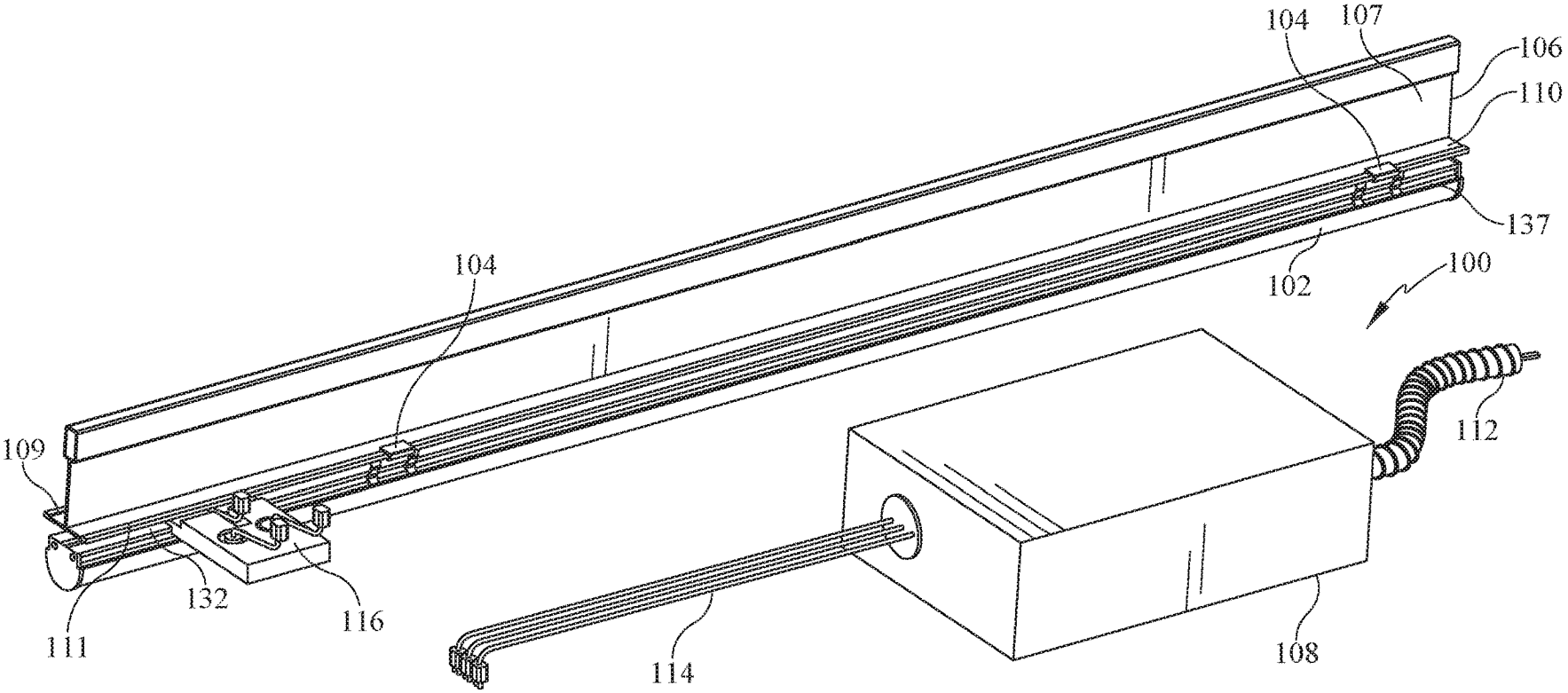
FIG. 1 is an upper perspective view of the lighting system of the present disclosure having a lamp mounted to a ceiling support grid.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This present disclosure may provide for less laborious installation or mounting of lamps or items to existing ceiling support grids. In at least one embodiment of the present disclosure, a lamp configured to mount solely to a lower flange of a ceiling support grid is provided. For example, typical ceiling support grids have a lower longitudinally extending flange and an upper longitudinally extending flange, the upper longitudinally extending flange perpendicularly extends from a longitudinally extending center axis of the lower longitudinally extending flange. The lamp of the present disclosure may have a longitudinally extending housing having a length substantially greater than a width and the housing may be configured to be mounted solely to the lower longitudinally extending flange of the ceiling support grid and have its longitudinal axis parallel with a longitudinal axis of the ceiling support grid. The width of the lamp may be similar or coincident with the width of the lower flange to which the lamp is mounted.

The system of the present disclosure may provide a ceiling grid mounting clip for the mounting of the items to the ceiling support grid. For example, a hook, a longitudinally extending lamp, or other items may be mounted solely to the ceiling support grid with the ceiling grid mounting clip disclosed herein. The ceiling grid mounting clip may have a first leg and a second leg. The first leg of the ceiling grid mounting clip may have a lower portion configured to cooperate with a first side of the lamp or item being mounted and an upper portion configured to cooperate with a second edge of the lower flange of the ceiling support grid. The second leg of the ceiling grid mounting clip may have a lower portion configured to cooperate with a second side of the lamp or item to be mounted and an upper portion configured to cooperate with a first edge of the lower flange. The first leg of the ceiling grid mounting clip may be configured to slidingly engage the second leg of the ceiling grid mounting clip, wherein the cooperation of the item being mounted with the lower portions of the legs of the ceiling grid mounting clip and the cooperation of the lower flange of the ceiling support grid with the upper portions of the legs of the ceiling grid mounting clip mounts and holds the item or lamp to the ceiling support grid.

In at least one embodiment of the presently disclosed lighting system, a lamp or other item may be mounted to a single, unitary, lower, linearly extending flange of the ceiling support grid and the lamp may solely extend down from the lower longitudinally extending flange to which it is mounted.

FIG. 1 shows an upper perspective view of lighting system 100 of the present disclosure having lamp 102 mounted to ceiling support grid 106. Ceiling support grid 106 has a lower longitudinally extending flange 110 and an upper longitudinally extending flange 107. Upper longitudinally extending flange 107 perpendicularly extends up from a longitudinally extending center axis of lower longitudinally extending flange 110. Lamp 102 has a longitudinally extending housing 132 having a length substantially greater than a width. Housing 132 may be configured to be mounted solely to lower longitudinally extending flange 110 of ceiling support grid 106 and have its longitudinal axis parallel with the longitudinal axis of lower longitudinally extending flange 110 to which it is mounted, and solely extend down from lower longitudinally extending flange 110 to which it is mounted. System 100 may also have at least one ceiling grid mounting clip 104 or at least one ceiling grid mounting magnet 204, shown in FIG. 2, configured for the mounting of lamp housing 132 solely to lower longitudinally extending flange 110 of the ceiling support grid 106.

Lamp 102 has a longitudinally extending housing 132 having a length substantially greater than a width. For example, the width of the housing 132 may be proximate a width of lower longitudinally extending flange 110. Lamp 102 may have a polarizing film, light guide, diffuser, lens, and/or cover which may be held with housing 132. A reflective material or reflective surface may also be used to direct light emitting from a light source onto an area to be illuminated with lamp 102.

Housing 132 is configured to be mounted solely to lower longitudinally extending flange 110 of ceiling support grid 106 and have its longitudinal axis aligned with the longitudinal axis of lower longitudinally extending flange 110 to which it is mounted.

Typical lamps in the prior art require a ceiling panel be removed to provide a ceiling grid opening for the mounting of a lamp and for the light to pass through the ceiling support grid. As disclosed herein, lamp 102 may be mounted to ceiling support grid 106 and ceiling panels may also be held with ceiling support grid 106 since lamp 102 extends down from ceiling support grid 106. The mounting of lamp 102 solely to a lower flange 110 enables the lower flange 110 to which lamp 102 is mounted to also hold a ceiling panel thereabove.

Figure 2:
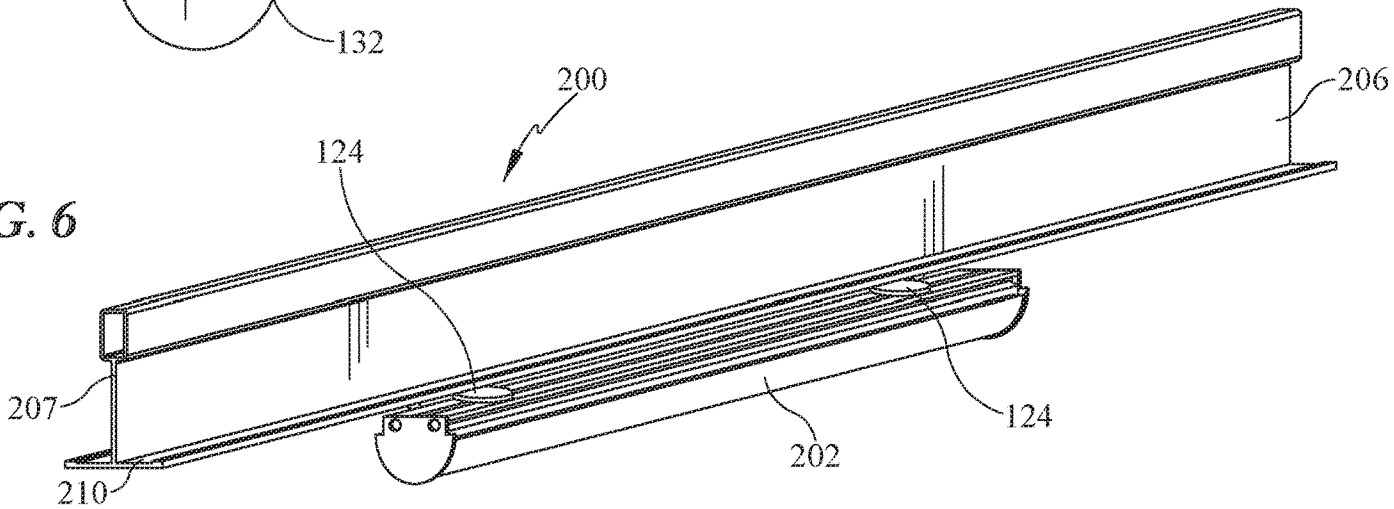
FIG. 2 is a perspective view of another embodiment of the lighting system of the present disclosure having a lamp mounted to a ceiling support grid.

FIG. 2 is a perspective view of lighting system 200 of the present disclosure. Lighting system 200 may have one or more ceiling grid mounting magnets 204 configured and disposed to mount lamp 202, or other item, to ceiling support grid 206. For example, ceiling support grid 206 may have a lower longitudinally extending flange 210 and an upper longitudinally extending flange 207, wherein upper longitudinally extending flange 207 perpendicularly extends up from a longitudinally extending center axis of lower longitudinally extending flange 210. Lower longitudinally extending flange 210 may have ferrous materials and may enable magnetic mounting of lamp 202 to lower longitudinally extending flange 210.

In at least one embodiment, lamp 102 comprises an array of low voltage LEDs housed in longitudinally extending housing 132. Lighting system 100 may have a battery and/or electrical circuitry, illustratively shown as electronics 108, in electrical communication with the array of LEDs housed in longitudinally extending housing 132. The battery may be configured to be mounted above lower longitudinally extending flange 110 of ceiling support grid 106 to which housing 132 is mounted. In at least one embodiment, the battery may be in wireless communication with lamp 102. For example, the battery and electronics, 108, may be configured for inductive powering lamp 102 by wirelessly energizing lamp 102 with an electromagnetic field and transferring energy to lamp 102 using electromagnetic induction. In at least one other embodiment, lighting system 100 has electrical lines 114 configured and disposed to power lamp 102.

In at least one embodiment of the present disclosure, lighting system 100 has electrical circuitry in electrical communication with a battery, circuitry and battery schematically shown as 108, and an array of low voltage LEDs in lamp 102. The electrical circuitry may be configured and disposed to switch a power supply to the array of low voltage LEDs to supply power with the battery. For example, lighting system 100 may be configured to provide emergency light upon an interruption of power from an external power supply, wherein an external power supply supplies power to lighting system 100 with electrical lines 112.

Lighting system 100 may have an emergency light tester configured to remotely or directly test the operation of the electrical circuitry, the battery, and the array of low voltage LEDs. For example, an adapter 116 may be configured to electrically connect lamp 202 with electrical lines 114 and may also have an emergency light tester.

In at least one embodiment, lighting system 100 has a wireless emergency light tester with wireless communications circuitry configured for the remote testing of the operation of the electrical circuitry, the battery, and the array of low voltage LEDs. For example, lighting system 100 may be configured to be operated and/or tested remotely with a portable wireless device such as a smart phone, tablet, or other wireless communications device.

In at least one embodiment, lighting system 100 is void of an electronic driver. For example, lamp 102 may be configured to provide illumination directly from a power supply. In at least one other embodiment, lighting system 100 has a driver, illustratively shown as electronics 108.

Figure 3:
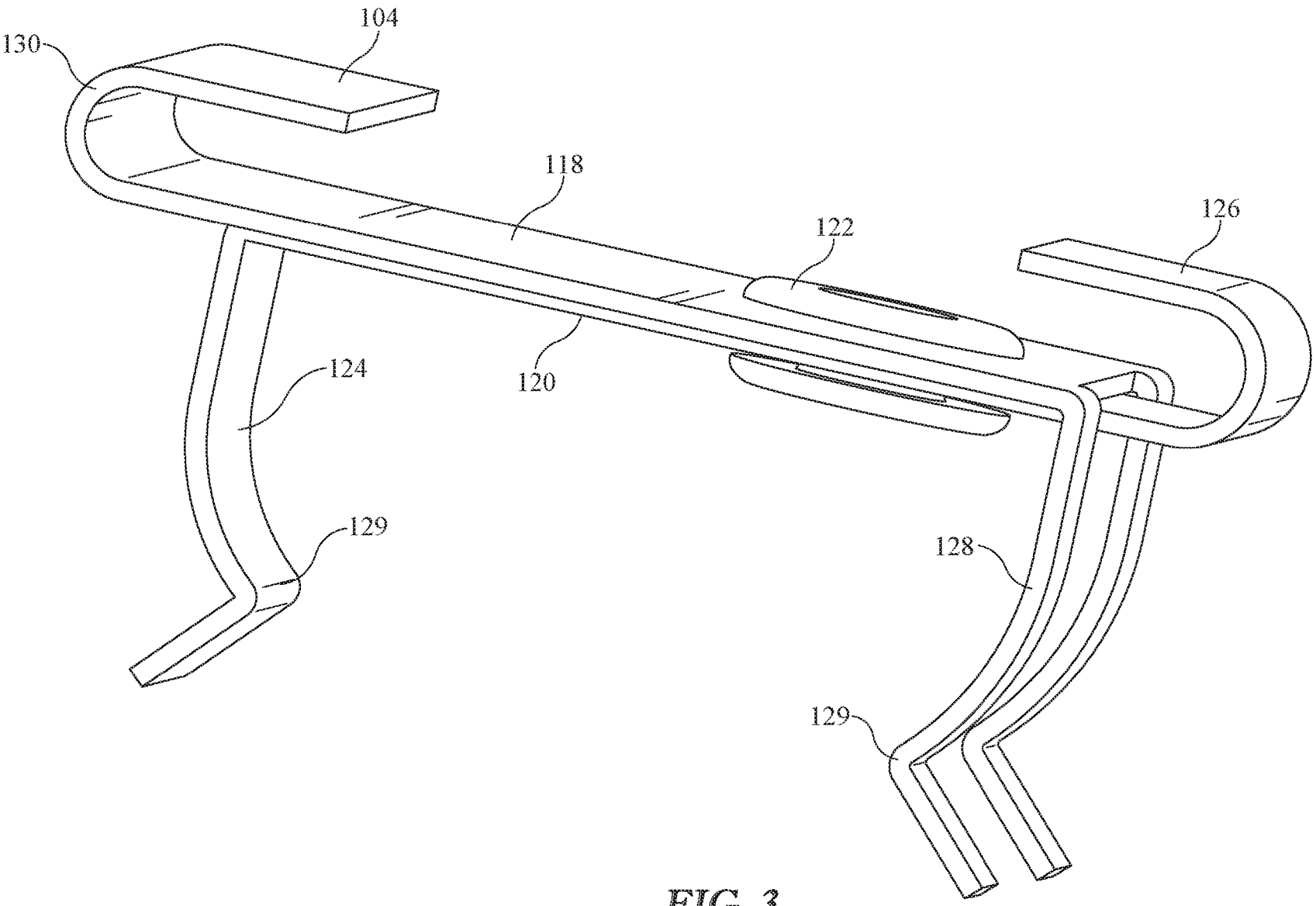
FIG. 3 is an upper perspective view of a ceiling grid mounting clip of the present disclosure.
Figure 4:
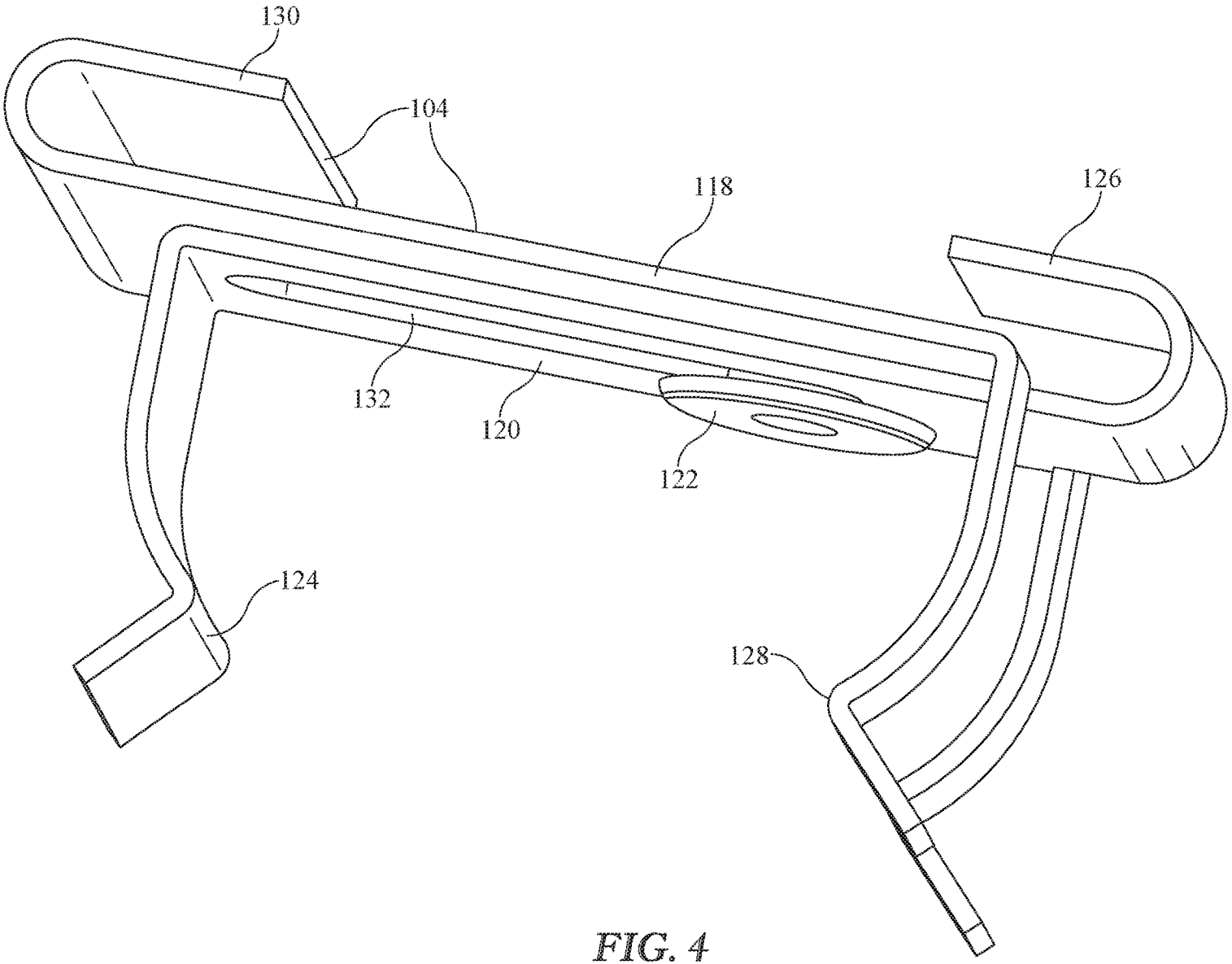
FIG. 4 is a lower perspective view of the ceiling grid mounting clip shown in FIG. 3.

FIG. 3 shows an upper perspective view of ceiling grid mounting clip 104 and FIG. 4 shows a lower perspective view of the ceiling grid mounting clip 104. Ceiling grid mounting clip 104 is configured for mounting an item, such as lamp 102, to ceiling support grid 106 having lower longitudinally extending flange 110 with a first edge 109 and a second edge 111, shown in FIG. 5. Ceiling grid mounting clip 104 has a first leg 118 having a lower portion 128 configured and disposed to cooperate with a first side 134 of the item, lamp 102 for example, to be mounted and an upper portion 130 configured and disposed to cooperate with the second edge 111 of lower longitudinally extending flange 110.

Second leg 120 has a lower portion 124 configured and disposed to cooperate with a second side 136 of item to be mounted, for example lamp 102, and an upper portion 126 configured and disposed to cooperate with the first edge 109 of lower longitudinally extending flange 110.

First leg 118 of ceiling grid mounting clip 104 is configured and disposed to slidingly engage second leg 120 of ceiling grid mounting clip 104 and the cooperation of the item such as lamp 102 with the lower portions, 124 and 128, of the legs, 120 and 118, of ceiling grid mounting clip 104 and the cooperation of lower longitudinally extending flange 110 with the upper portions, 126 and 130, of legs, 120 and 118, of ceiling grid mounting clip 104 holds and mounts the item to ceiling support grid 106.

For example, second leg 120 of ceiling grid mounting clip 104 may have a slot 132 configured and disposed to slidingly engage with fastener 122 extending from first leg 118 of ceiling grid mounting clip 104 as shown in FIG. 4.

In at least one embodiment, one of the first leg 118 of ceiling grid mounting clip 104 and the second leg 120 of ceiling grid mounting clip 104 has a fastener 122 configured and disposed to slidingly cooperate with slot 132 in the other of first leg 118 of ceiling grid mounting clip 104 and second leg 120 of the ceiling grid mounting clip 104. Lower portions 124 and 128 of legs 118 and 120 may have a spring material providing a mounting inward force to both lower flange 110 and sides of lamp 102, upon the mounting of lamp 102 to ceiling support grid 106.

In at least one other embodiment, lower portions 124 and 128 of legs 118 and 120 have a contoured portion configured and disposed for cooperating with contours in sides of lamp 102 or other item to be mounted. For example, lower portions 124 and 128 of legs 118 and 120 may have an angular portion 129 as shown in FIGS. 3 and 4. In at least one embodiment, the contoured portion of the lower portions 124 and 128 of legs 118 and 120 are configured and disposed for longitudinal movement of the item upon the item being mounted in the ceiling grid mounting clip 104. For example, lamp 102 may have longitudinally extending notches 137 or valleys as shown in FIG. 1.

Figure 6:
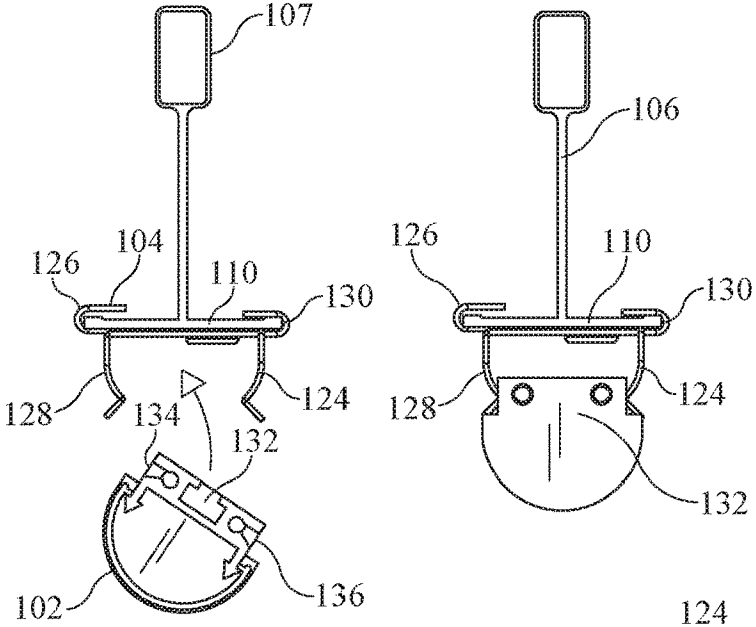
FIG. 6 shows the mounting of a lamp to the ceiling support grid with the ceiling grid mounting clip shown in FIG. 3.

In at least one further embodiment, ceiling grid mounting clip 104 has contoured portions in lower portions 124 and 128 of legs 118 and 120 configured and disposed for vertical mounting and removal of the item to be mounted between the lower portions of the first leg and the second leg of the ceiling grid mounting clip. For example, the legs may extend beyond an angle and as shown in FIG. 6, a vertical installation of lamp 102 between lower portions 124 and 128 may be performed by simply pushing lamp 102 onto ceiling grid mounting clip 104. Additionally, a vertical removal of lamp 102 may be performed by simply pulling lamp 102 from ceiling grid mounting clip 104.

Figure 5:
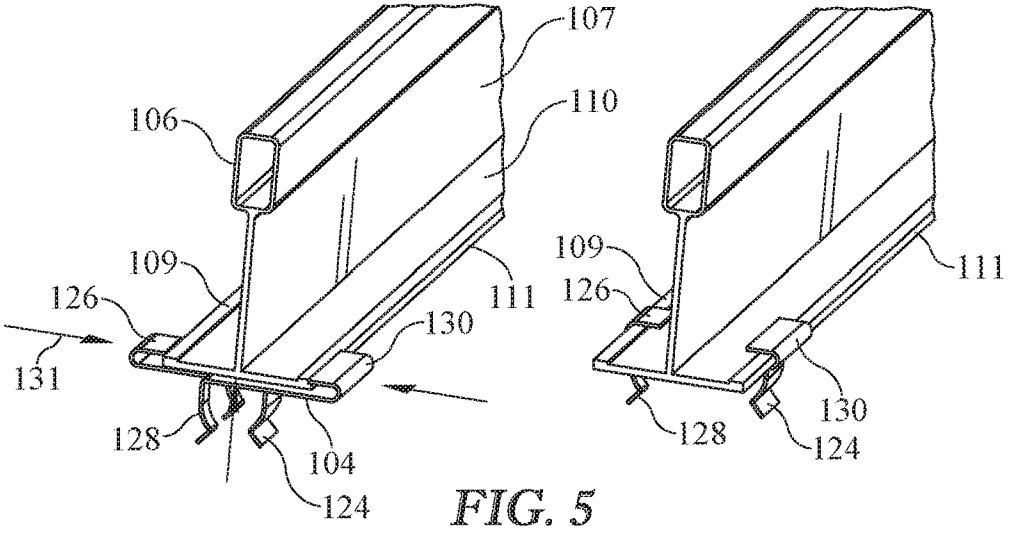
FIG. 5 shows the ceiling grid mounting clip shown in FIG. 3 and cooperation of the ceiling grid mounting clip with the lower flange of the ceiling support grid.

FIG. 5 shows ceiling grid mounting clip 104 in cooperation with lower flange 110 of ceiling support grid 106 and FIG. 6 shows the mounting of lamp 102 to ceiling support grid 106 with ceiling grid mounting clip 104. The left diagram in FIG. 5 shows upper portions 126 and 130 slid apart for the fitting of ceiling grid mounting clip 104 onto lower flange 110 of ceiling support grid 106. The right diagram in FIG. 5 shows upper portions 126 and 130 slid together for the mounting of the item or lamp 102 onto lower flange 110 of ceiling support grid 106. As shown in FIG. 6, upon mounting an item between the lower portions, 128 and 124, of ceiling grid mounting clip 104, a separating force is applied to the lower portions, 128 and 124, which in turn forces upper portions 126 and 130 together and holds and mounts lamp 102 solely to lower longitudinally extending flange 110. For example, lower portions 128 and 124 may have spring like extensions that are configured to receive sides of lamp 102 and hold lamp 102 therebetween and transfer the separating force between lower portions 128 and 124 to a grasping or mounting force to upper portions 126 and 130.

FIG. 6 shows the mounting of lamp 102 to ceiling support grid 106 with ceiling grid mounting clip 104. In at least one embodiment of the present disclosure, longitudinally extending lamp 102 may be mounted to ceiling support grid 110 by aligning a longitudinally extending axis of lamp 102 with a longitudinally extending axis of ceiling support grid 106, such as the longitudinal axis of lower longitudinally extending flange 110. Cooperation of at least one ceiling grid mounting clip 104 or at least one magnet 204 with longitudinally extending lamp 102 and lower longitudinally extending flange 110 of ceiling support grid holds and mounts aligned lamp 102 solely to ceiling support grid 106, wherein lamp 102 solely extends down from the lower longitudinally extending flange 110 to which it is mounted.

Lamp 102 may be electrically communicated with a power supply, for example a battery, an external power supply, or both. For example, a battery may be installed above ceiling support grid 106 and placed in electrical communication with lamp 102, as illustratively shown in FIG. 1. Lamp 102 may be an emergency lamp and the operation of the emergency lamp and the battery may be directly or remotely tested. For example, lighting system 100 may be configured for wirelessly communicating the emergency lamp with a portable electronic device for testing.

Figure 7:
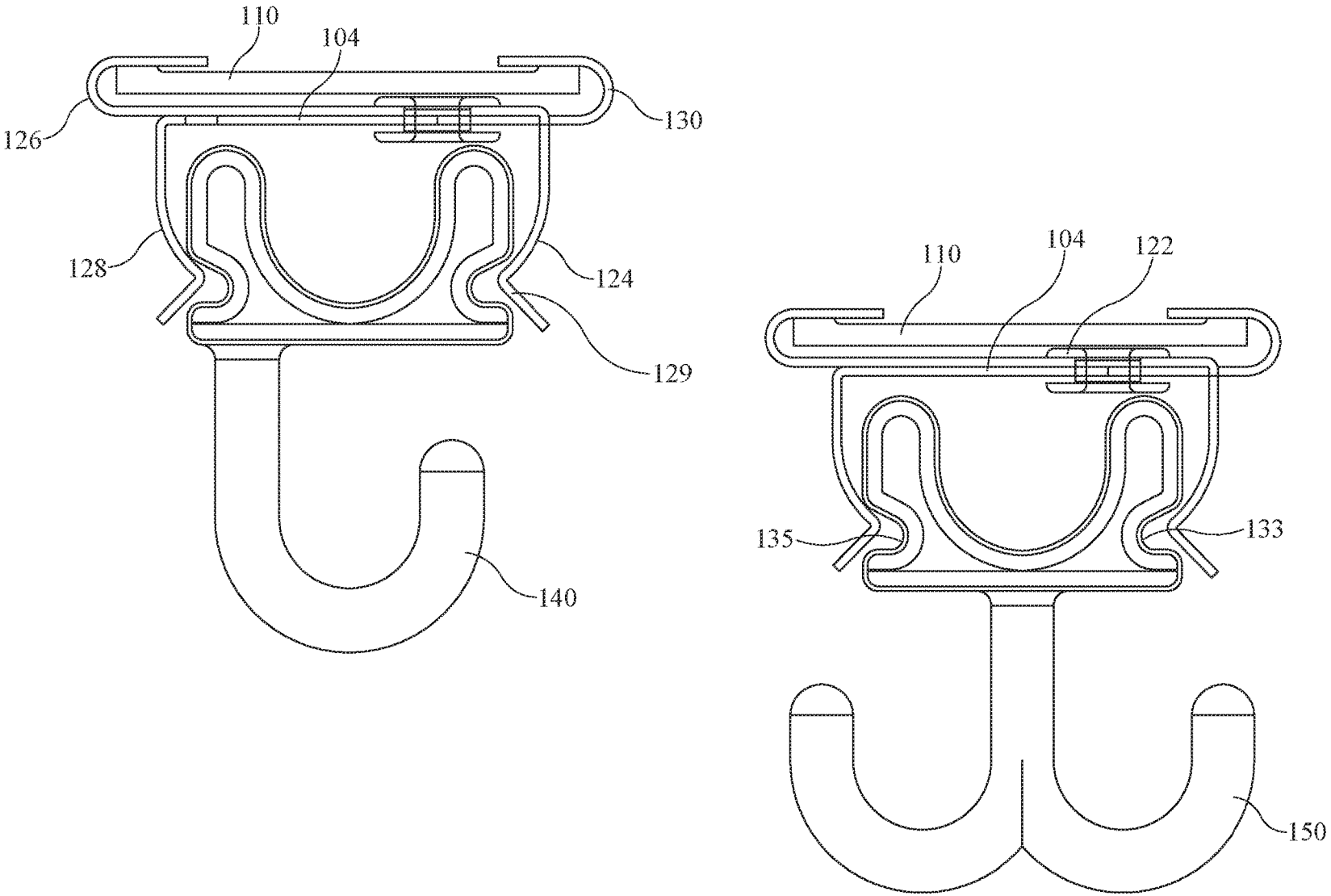
FIG. 7 illustratively shows the mounting of items to a ceiling support grid with the ceiling grid mounting clip shown in FIG. 3.

FIG. 7 illustratively shows the mounting of items other than a lamp to a ceiling support grid with ceiling grid mounting clip 104. For example, items such as hooks may be mounted to the ceiling support grid with ceiling grid mounting clip 104. As shown in FIG. 7, a single hook 140 or a double hook 150 may be mounted solely to lower longitudinally extending flange 110 and extend down from lower longitudinally extending flange 110 ceiling grid, with mounting clip 104. Hooks 140 and 150 have notches 133 and 135 configured and disposed to cooperate with contoured or angular portions 129 of lower portions 128 and 124. It is to be understood that a variety of other items, in addition to lamps and hooks, can be configured to be mounted solely to lower longitudinally extending flange 110 with ceiling grid mounting clip 104.

Disclosed herein is a system configured for mounting items to a ceiling support grid and method of mounting. For example, lighting system 100 has lamp 102 mounted to a ceiling support grid 106. Ceiling support grid 106 has a lower longitudinally extending flange 110 and an upper longitudinally extending flange 107, wherein upper longitudinally extending flange 107 perpendicularly extends from a longitudinally extending center axis of lower longitudinally extending flange 110. Lamp 102 has a longitudinally extending housing 132, having a length substantially greater than a width. The width housing 132 may be proximate a width of lower longitudinally extending flange 110.

Housing 132 is configured to be mounted solely to lower longitudinally extending flange 110 of ceiling support grid 106 and has its longitudinal axis in line with the longitudinal axis of lower flange 110 to which it is mounted. Systems disclosed herein provide for the mounting of items such as housing 132 to lower longitudinally extending flange 110 with a mount, clip, fastener, adhesive, magnet, or other mounting material or device that cooperates solely with lower flange 110. For example, the mounting of lamp 102 to lower flange 110 is void of any fasteners, mounts, or other mounting materials or devices that cooperate with anything other than lower flange 110 of ceiling support grid 106. In at least one embodiment of the present disclosure, lighting system 100 has one or more clips mounting lamp 102 solely to lower longitudinally extending flange 110 of ceiling support grid 106.

Lamp 102 may have an array of LEDs or an array of low voltage LEDs housed in the longitudinally extending housing 132. Lighting system 100 may have electronic circuitry 112 which is generally illustrated as a box 108 in FIG. 1 and is to be understood as illustrating electrical circuitry such as a driver, power switching device, battery, and/or other electrical devices to provide desired functions. For example, circuitry may include a battery and may be configured and disposed to switch a power supply to lamp 102 to supply power with the battery. An external power supply may be in electrical communication with circuitry with electrical lines 112. For example, circuitry may be configured to power lamp 102 with an external power supply 116 via electrical lines 112, and in the event of a power interruption, the circuitry may be configured to switch the power supplied to lamp 102 from the battery. In this configuration, lighting system 100 may provide emergency lighting in the event of a power interruption.

In at least one embodiment, lighting system 100 has a battery in electrical communication with an array of low voltage LEDs. Circuitry may be configured to be mounted above lower longitudinally extending flange 110 of ceiling support grid 106, as illustrated with box 108. Circuitry may have a driver or may be void of a driver. For example, circuitry in box 108 may be configured to power and illuminate lamp 102 directly with power supplied or battery and a driver may not be needed.

The circuitry may be configured to wirelessly power lamp 102. For example, circuitry may have inductive powering capabilities for powering lamp 102 with a battery or external power supply. Inductive powering is a type of wireless power transfer that uses an electromagnetic field to transfer energy between two objects using electromagnetic induction, the production of electricity across a magnetic field. For example, energy may be sent through an inductive coupling to lamp 102, which can then use that energy illuminate.

There is thus provided a lighting system having an LED light panel and a method of installing a lighting system in a ceiling support grid. One feature or aspect of an illustrative example is believed at the time of the filing of this patent application to possibly reside broadly in a lighting system configured for mounting a lamp to a ceiling support grid, the ceiling support grid comprising: a lower longitudinally extending flange and an upper longitudinally extending flange, wherein the upper longitudinally extending flange perpendicularly extends up from a longitudinally extending center axis of the lower longitudinally extending flange; a lamp comprising: a longitudinally extending housing having a length substantially greater than a width; the housing being configured to be mounted solely to the lower longitudinally extending flange of the ceiling support grid, have its longitudinal axis parallel with the longitudinal axis of lower longitudinally extending flange to which it is mounted, and solely extend down from the lower longitudinally extending flange to which it is mounted; and at least one ceiling grid mounting clip or at least one ceiling grid mounting magnet configured for the mounting of the lamp housing solely to the lower longitudinally extending flange of the ceiling support grid.

Another feature or aspect of an illustrative example is believed at the time of the filing of this patent application to possibly reside broadly in the lighting system comprising at least one ceiling grid mounting clip, wherein the at least one ceiling grid mounting clip comprises a first leg and a second leg, the lamp housing comprises a first side and a second side, the lower flange of the ceiling support grid comprises a first edge and a second edge, the first leg of the ceiling grid mounting clip has a lower portion configured to cooperate with the first side of the lamp and an upper portion configured to cooperate with the second edge of the lower flange, the second leg of the ceiling grid mounting clip has a lower portion configured to cooperate with the second side of the lamp and an upper portion configured to cooperate with the first edge of the lower flange, the first leg of the ceiling grid mounting clip is configured to slidingly engage the second leg of the ceiling grid mounting clip, wherein the cooperation of the lamp with the lower portions of the legs of the ceiling grid mounting clip and the cooperation of the lower flange with the upper portions of the legs of the ceiling grid mounting clip holds the lamp to the ceiling support grid.

Still another feature or aspect of an illustrative example is believed at the time of the filing of this patent application to possibly reside broadly in the lighting system, wherein the lamp comprises an array of low voltage LEDs housed in the longitudinally extending housing.

A further feature or aspect of an illustrative example is believed at the time of the filing of this patent application to possibly reside broadly in the lighting system further comprising a battery in electrical communication with the array of low voltage LEDs, the battery being configured to be mounted above the lower longitudinally extending flange of the ceiling support grid to which the housing is mounted.

Another feature or aspect of an illustrative example is believed at the time of the filing of this patent application to possibly reside broadly in the lighting system, wherein the battery is in wireless communication with the lamp.

A further feature or aspect of an illustrative example is believed at the time of the filing of this patent application to possibly reside broadly in the lighting system further comprising electrical circuitry in electrical communication with the battery and the array of low voltage LEDs, the electrical circuitry being configured and disposed to switch a power supply to the array of low voltage LEDs to supply power with the battery.

Yet another feature or aspect of an illustrative example is believed at the time of the filing of this patent application to possibly reside broadly in the lighting system further comprising an emergency light tester configured to remotely or directly test the operation of the electrical circuitry, the battery, and the array of low voltage LEDs.

Still another feature or aspect of an illustrative example is believed at the time of the filing of this patent application to possibly reside broadly in the lighting system, wherein the emergency light tester has wireless communications circuitry configured for the remote testing of the operation of the electrical circuitry, the battery, and the array of low voltage LEDs.

Another feature or aspect of an illustrative example is believed at the time of the filing of this patent application to possibly reside broadly in the lighting system being void of a driver.

Yet another feature or aspect of an illustrative example is believed at the time of the filing of this patent application to possibly reside broadly in a method of mounting a longitudinally extending lamp to a ceiling support grid comprising the steps of: aligning a longitudinally extending axis of the lamp with a longitudinally extending axis of the ceiling support grid; cooperating at least one ceiling grid mounting clip or at least one magnet with the longitudinally extending lamp and a lower longitudinally extending flange of the ceiling support grid and mounting the aligned lamp solely to the ceiling support grid, wherein the lamp solely extends down from the lower longitudinally extending flange to which it is mounted; and electrically communicating the lamp with a power supply.

One feature or aspect of an illustrative example is believed at the time of the filing of this patent application to possibly reside broadly the method of mounting a lamp further comprising installing a battery above the ceiling support grid and electrically communicating the battery with the lamp.

Another feature or aspect of an illustrative example is believed at the time of the filing of this patent application to possibly reside broadly in the method of mounting a lamp, wherein the lamp is an emergency lamp and the method further comprises a step of directly or remotely testing the operation of the emergency lamp and the battery.

Yet another feature or aspect of an illustrative example is believed at the time of the filing of this patent application to possibly reside broadly in the method of mounting a lamp, wherein the step of testing the operation of the emergency lamp comprises wirelessly communicating the emergency lamp with a portable electronic device.

Still another feature or aspect of an illustrative example is believed at the time of the filing of this patent application to possibly reside broadly in the method of mounting a lamp, wherein the step of mounting the aligned lamp solely to the ceiling support grid comprises clipping the lamp to the ceiling support grid.

A further feature or aspect of an illustrative example is believed at the time of the filing of this patent application to possibly reside broadly in a ceiling grid mounting clip configured for mounting an item to a ceiling support grid having a lower longitudinally extending flange with a first edge and a second edge, the ceiling grid mounting clip comprising: a first leg having a lower portion configured and disposed to cooperate with a first side of the item to be mounted and an upper portion configured and disposed to cooperate with the second edge of the lower longitudinally extending flange; a second leg having a lower portion configured and disposed to cooperate with a second side of the item to be mounted and an upper portion configured and disposed to cooperate with the first edge of the lower longitudinally extending flange; and wherein the first leg of the ceiling grid mounting clip is configured and disposed to slidingly engage the second leg of the ceiling grid mounting clip and the cooperation of the item being mounted with the lower portions of the legs of the ceiling grid mounting clip and the cooperation of the lower flange with the upper portions of the legs of the ceiling grid mounting clip holds and mounts the item to the ceiling support grid.

Another feature or aspect of an illustrative example is believed at the time of the filing of this patent application to possibly reside broadly in the ceiling grid mounting clip, wherein one of the first leg of the ceiling grid mounting clip and the second leg of the ceiling grid mounting clip has a fastener configured and disposed to slidingly cooperate with a slot in the other of the first leg of the ceiling grid mounting clip and the second leg of the ceiling grid mounting clip.

Yet another feature or aspect of an illustrative example is believed at the time of the filing of this patent application to possibly reside broadly in the ceiling grid mounting clip, wherein the lower portions of the legs comprise a spring material.

Still another feature or aspect of an illustrative example is believed at the time of the filing of this patent application to possibly reside broadly in the ceiling grid mounting clip, wherein the lower portions of the legs have contoured portion configured and disposed for cooperating with contours in sides of the item to be mounted.

A further feature or aspect of an illustrative example is believed at the time of the filing of this patent application to possibly reside broadly in the ceiling grid mounting clip, wherein the contoured portion of the lower portions of the legs are configured and disposed for longitudinal movement of the item upon the item being mounted in the ceiling grid mounting clip.

One feature or aspect of an illustrative example is believed at the time of the filing of this patent application to possibly reside broadly in the ceiling grid mounting clip, wherein the contoured portion of the lower portions of the legs are configured and disposed for vertical mounting and removal of the item to be mounted between the lower portions of the first leg and the second leg of the ceiling grid mounting clip.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

AT LEAST PARTIAL NOMENCLATURE

100 lighting system
102 lamp
104 ceiling grid mounting clip
106 ceiling support grid
107 upper longitudinally extending flange
108 driver and or battery
109 first edge of lower longitudinally extending flange
110 lower longitudinally extending flange
111 second edge of lower longitudinally extending flange
112 electrical lines to external power supply
114 electrical lines to lamp
116 lamp power connector

118 first leg of ceiling grid mounting clip
120 second leg of ceiling grid mounting clip
122 fastener
124 lower portion of second leg of ceiling grid mounting clip
126 upper portion of second leg of ceiling grid mounting clip
128 lower portion of first leg of ceiling grid mounting clip
129 contoured or angular portion of lower portion of legs
130 upper portion of first leg of ceiling grid mounting clip
132 lamp housing
133 notch
134 first side of lamp housing
135 notch
136 second side of lamp housing
137 longitudinally extending notch
140 hook
150 double hook
200 lighting system
202 lamp
204 ceiling grid mounting magnet
206 ceiling support grid
207 upper longitudinally extending flange
210 lower longitudinally extending flange

The invention claimed is:

1. A lighting system configured for mounting a lamp to a ceiling support grid, the ceiling support grid comprising:

a lower longitudinally extending flange and an upper longitudinally extending flange, wherein the upper longitudinally extending flange perpendicularly extends up from a longitudinally extending center axis of the lower longitudinally extending flange;

a lamp comprising:

a longitudinally extending housing having a length substantially greater than a width;

the housing being configured to be mounted solely to the lower longitudinally extending flange of the ceiling support grid, have its longitudinal axis parallel with the longitudinal axis of lower longitudinally extending flange to which it is mounted, and solely extend down from the lower longitudinally extending flange to which it is mounted;

at least one ceiling grid mounting clip or at least one ceiling grid mounting magnet configured for the mounting of the lamp housing solely to the lower longitudinally extending flange of the ceiling support grid; and wherein the at least one ceiling grid mounting clip comprises a first leg and a second leg, the lamp housing comprises a first side and a second side, the lower flange of the ceiling support grid comprises a first edge and a second edge, the first leg of the ceiling grid mounting clip has a lower portion configured to cooperate with the first side of the lamp and an upper portion configured to cooperate with the second edge of the lower flange, the second leg of the ceiling grid mounting clip has a lower portion configured to cooperate with the second side of the lamp and an upper portion configured to cooperate with the first edge of the lower flange, the first leg of the ceiling grid mounting clip is configured to slidingly engage the second leg of the ceiling grid mounting clip, wherein the cooperation of the lamp with the lower portions of the legs of the ceiling grid mounting clip and the cooperation of the lower flange with the upper portions of the legs of the ceiling grid mounting clip holds the lamp to the ceiling support grid.

2. The lighting system of claim 1, wherein the lamp comprises an array of low voltage LEDs housed in the longitudinally extending housing.

3. The lighting system of claim 2 further comprising a battery in electrical communication with the array of low voltage LEDs, the battery being configured to be mounted above the lower longitudinally extending flange of the ceiling support grid to which the housing is mounted.

4. The lighting system of claim 3, wherein the battery is in wireless communication with the lamp.

5. The lighting system of claim 4 further comprising electrical circuitry in electrical communication with the battery and the array of low voltage LEDs, the electrical circuitry being configured and disposed to switch a power supply to the array of low voltage LEDs to supply power with the battery.

6. The lighting system of claim 5 further comprising an emergency light tester configured to remotely or directly test the operation of the electrical circuitry, the battery, and the array of low voltage LEDs.

7. The lighting system of 6, wherein the emergency light tester has wireless communications circuitry configured for the remote testing of the operation of the electrical circuitry, the battery, and the array of low voltage LEDs.

8. A method of mounting a longitudinally extending lamp to a ceiling support grid comprising the steps of:

aligning a longitudinally extending axis of the lamp with a longitudinally extending axis of the ceiling support grid;

cooperating at least one ceiling grid mounting clip or at least one magnet with the longitudinally extending lamp and a lower longitudinally extending flange of the ceiling support grid and mounting the aligned lamp solely to the ceiling support grid, wherein the lamp solely extends down from the lower longitudinally extending flange to which it is mounted;

wherein the cooperating of the at least one ceiling grid mounting clip comprises cooperating a lower portion of a first leg of the at least one ceiling grid mounting clip with a first side of the lamp and cooperating an upper portion of the first leg with a second edge of the lower flange, cooperating a lower portion of a second leg of the at least one ceiling grid mounting clip with a second side of the lamp and cooperating an upper portion of the second leg with a first edge of the lower flange, and slidingly engaging the first leg of the ceiling grid mounting clip with the second leg of the ceiling grid mounting clip and holding the lamp to the ceiling support grid;

and electrically communicating the lamp with a power supply, wherein the electrical communication of the lamp with the power supply is wireless or wired.

9. The method of mounting a lamp of claim 8 further comprising installing a battery above the ceiling support grid and electrically communicating the battery with the lamp.

10. The method of mounting a lamp of claim 9, wherein the lamp is an emergency lamp and the method further comprises a step of directly or remotely testing the operation of the emergency lamp and the battery.

11. The method of mounting a lamp of claim 10, wherein the step of testing the operation of the emergency lamp comprises wirelessly communicating the emergency lamp with a portable electronic device.

12. The method of mounting a lamp of claim 8, wherein the step of mounting the aligned lamp solely to the ceiling support grid comprises clipping the lamp to the ceiling support grid.

13. A ceiling grid mounting clip configured for mounting an item to a ceiling support grid having a lower longitudinally extending flange with a first edge and a second edge, the ceiling grid mounting clip comprising:

a first leg having a lower portion configured and disposed to cooperate with a first side of the item to be mounted and an upper portion configured and disposed to cooperate with the second edge of the lower longitudinally extending flange;

a second leg having a lower portion configured and disposed to cooperate with a second side of the item to be mounted and an upper portion configured and disposed to cooperate with the first edge of the lower longitudinally extending flange; and wherein the first leg of the ceiling grid mounting clip is configured and disposed to slidingly engage the second leg of the ceiling grid mounting clip and the cooperation of the item being mounted with the lower portions of the legs of the ceiling grid mounting clip and the cooperation of the lower flange with the upper portions of the legs of the ceiling grid mounting clip holds and mounts the item to the ceiling support grid.

14. The ceiling grid mounting clip of claim 13, wherein one of the first leg of the ceiling grid mounting clip and the second leg of the ceiling grid mounting clip has a fastener configured and disposed to slidingly cooperate with a slot in the other of the first leg of the ceiling grid mounting clip and the second leg of the ceiling grid mounting clip.

15. The ceiling grid mounting clip of claim 13, wherein the lower portions of the legs comprise a spring material.

16. The ceiling grid mounting clip of claim 13, wherein the lower portions of the legs have contoured portion configured and disposed for cooperating with contours in sides of the item to be mounted.

17. The ceiling grid mounting clip of claim 16, wherein the contoured portion of the lower portions of the legs are configured and disposed for longitudinal movement of the item upon the item being mounted in the ceiling grid mounting clip.

18. The ceiling grid mounting clip of claim 16, wherein the contoured portion of the lower portions of the legs are configured and disposed for vertical mounting and removal of the item to be mounted between the lower portions of the first leg and the second leg of the ceiling grid mounting clip.

* * * * *